United States Patent [19]

Schoen

[11] Patent Number: 4,460,094

[45] Date of Patent: Jul. 17, 1984

[54] ARTICLE HOLDING DEVICE

[76] Inventor: Edmund R. Schoen, 1662 Rampart Rd., Addison, Ill. 60101

[21] Appl. No.: 478,465

[22] Filed: Mar. 24, 1983

[51] Int. Cl.[3] ..... A47F 7/08

[52] U.S. Cl. ..... 211/35; 248/235

[58] Field of Search ..... 211/35, 34, 87, 37; 5/503; 248/235

[56] References Cited

U.S. PATENT DOCUMENTS

| | | | |
|---|---|---|---|
| 358,766 | 3/1887 | Albro | 248/235 |
| 384,334 | 6/1888 | Reichenbach | 211/34 |
| 1,391,983 | 9/1921 | Schuster | 248/235 |
| 1,692,681 | 11/1928 | Monsees | 211/35 |
| 1,977,157 | 10/1934 | Strobel | 211/37 X |
| 2,295,886 | 9/1942 | Beck | 211/35 |
| 4,203,175 | 5/1980 | Heine | 5/503 |

FOREIGN PATENT DOCUMENTS

| | | | |
|---|---|---|---|
| 81337 | 2/1953 | Netherlands | 211/35 |
| 15285 | of 1900 | United Kingdom | 211/35 |
| 767215 | 1/1957 | United Kingdom | 211/34 |

*Primary Examiner*—Ramon S. Britts
*Assistant Examiner*—Sarah A. Lechok
*Attorney, Agent, or Firm*—Marshall, O'Toole, Gerstein, Murray & Bicknell

[57] ABSTRACT

A device for supporting and storing one or more articles, such as a pair of shoes, in upright positions on a vertical surface, such as a wall or side of a door. The device includes a pair of elongated, support members that are adapted to be secured to the vertical surface in vertically extending, laterally spaced relation. Each support member includes a mounting portion, a retaining portion spaced from the mounting portion, and an obliquely extending connecting portion that connects the mounting and retaining portions. A crossbar extends between the mounting portions of the supprot members and retains the support members in laterally spaced, parallel relation. When the device is mounted on a vertical surface, the retaining portions are spaced from the surface.

7 Claims, 6 Drawing Figures

ARTICLE HOLDING DEVICE

BACKGROUND OF THE INVENTION (1) Field of the Invention

This invention relates to a device for supporting articles on a vertical surface, and more particularly relates to a device for supporting a pair of shoes or the like on the facing surface of a vertical wall, door, or the like.

2. Description of the Prior Art

Various types of support or holding devices have been heretofore developed for supporting articles, such as shoes and the like, on vertical surfaces, such as an interior wall of a closet, or the side of a door, in order to conserve storage space in the closet or elsewhere. While many of these devices have achieved their intended purpose, some were subject to certain disadvantages, such as difficulty in effecting engagement and disengagement of the articles therefrom, and excessive bulk. Compartmented cloth or plastic shoe bags are examples of article supporting devices which suffer from the aforementioned defects, particularly after the bag has been in use for some time.

SUMMARY OF THE INVENTION

Briefly described, in its broader aspects, the present invention contemplates a novel device for supporting and storing small articles, such as shoes or the like, on a vertical surface, such that the articles may be rapidly and easily engaged with and disengaged from the device when it is desired to store or use the articles, respectively. In its more specific aspects, the present invention contemplates a novel device for supporting at least one and preferably a pair of shoes in an upright position on the facing side of a vertical wall, such as an interior wall of a closet, or on the side of a door. The device thus comprises at least one and preferably a pair of elongated, vertically extending, laterally spaced support members, each of which includes a mounting portion that is adapted to be secured to a vertical surface, a retaining portion that is spaced from the mounting portion, and a connecting portion, which extends obliquely between the mounting and retaining portions so that the latter are spaced or offset from the vertical surface when the device is mounted thereon. The mounting portions are preferably connected by a connecting member formed integrally therewith.

The support members are generally of an elongated, plate-like form, each of which is provided with at least one and preferably a pair of longitudinally extending, laterally spaced strengthening ribs, which extend between the mounting and connecting portions thereof, and at least one longitudinally extending reinforcing rib which extends between the connecting and retaining portions. When a pair of shoes is engaged with the device, the retaining portions of the support members extend into the interiors of the shoes towards the toes thereof with the tongue portions of the shoes engaged with and supported at least by the connecting portions of each support member.

The device of the present invention may also be used to support other miscellaneous small articles such as file folders, hand and bath towels, and articles of clothing, it only being necessary to position such items between the upwardly extending retaining and connecting portions of one or the other or both support members, and the adjacent vertical surface on which the device is mounted, or to substantially center the article between both support members, depending upon the size and rigidity of the article.

Accordingly, it is a general object of the present invention to provide a novel and improved device for supporting and/or storing small articles on a vertical surface.

A more particular object is to provide a novel device of the foregoing character that is particularly adapted to support at least one and preferably a pair of shoes in an upright position on a vertical surface, such as the facing surface of a wall or the side of a door.

A specific object is to provide a novel one piece device for supporting a pair of shoes or the like in an upright position on the vertical or facing surface of a closet wall or door, such that the shoes may be easily and rapidly engaged with and removed from the device as need be.

Another object is to provide a novel device of the character described, which is simple in construction, reliable in operation, and economical to manufacture.

Other objects and advantages of the invention will become apparent from the detailed description which follows and accompanying sheets of drawings.

DESCRIPTION OF THE PREFERRED EMBODIMENT

Figure 1:
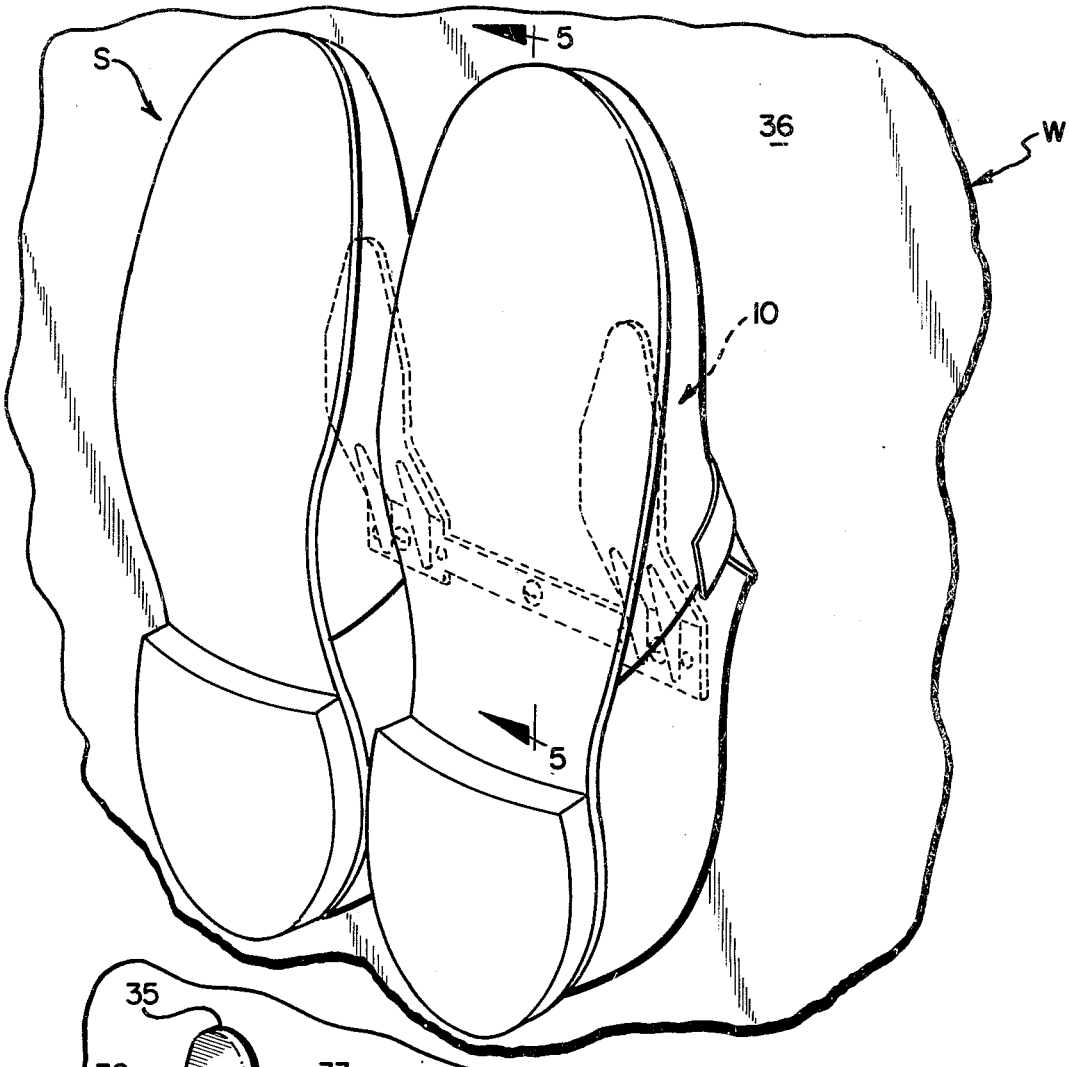
FIG. 1 is a perspective view showing the article supporting device of the present invention in broken lines as it would appear when mounted on a vertical surface and also showing, in full lines, the approximate positions that a pair of shoes would occupy when engaged with the device.
Figure 2:
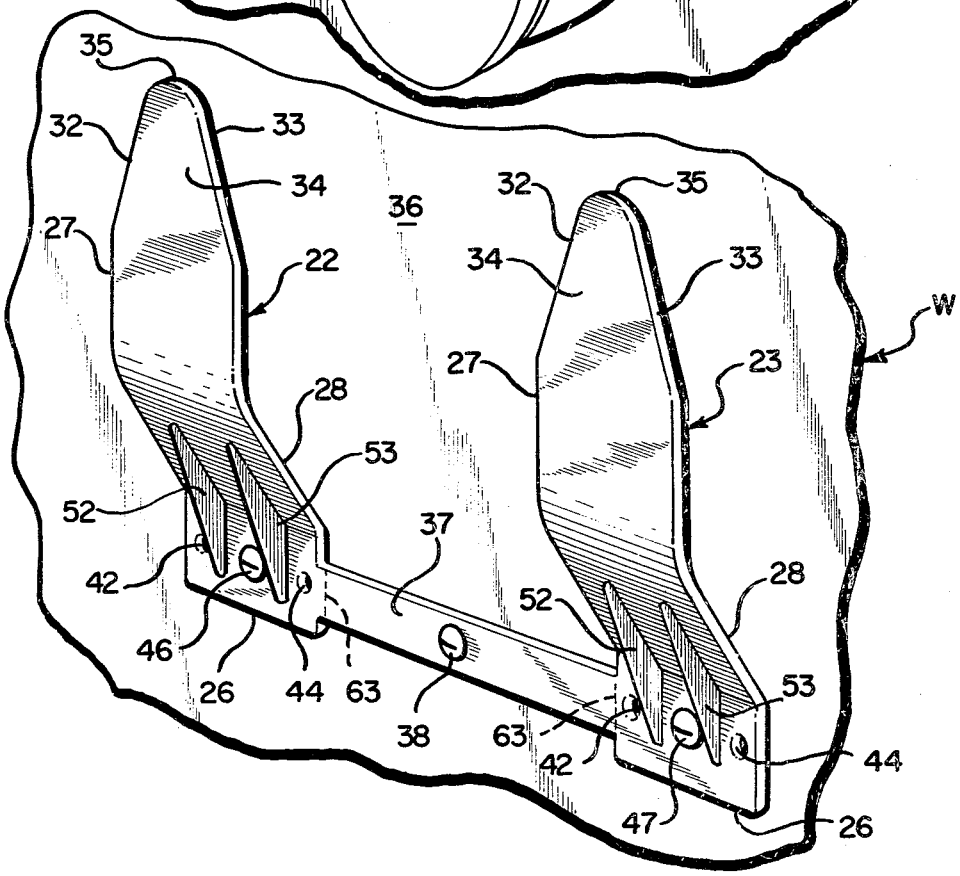
FIG. 2 is a perspective view of the device of the present invention as it would appear when mounted on a vertical surface and not in use.

Referring initially to FIGS. 1 and 2, an article supporting device embodying the features of the present invention is illustrated and indicated generally at 10, the device 10 being illustrated in broken lines in FIG. 1 and in full lines in FIG. 2. A pair of men's shoes, indicated generally at S in FIG. 1, are shown as they would appear when operatively engaged with and supported by the device 10. The right and left shoes of the pair illustrated in FIG. 1 are respectively indicated at 12 and 13. It will be understood that the device 10 may also be used to support and store women's and children's shoes.

Figure 3:
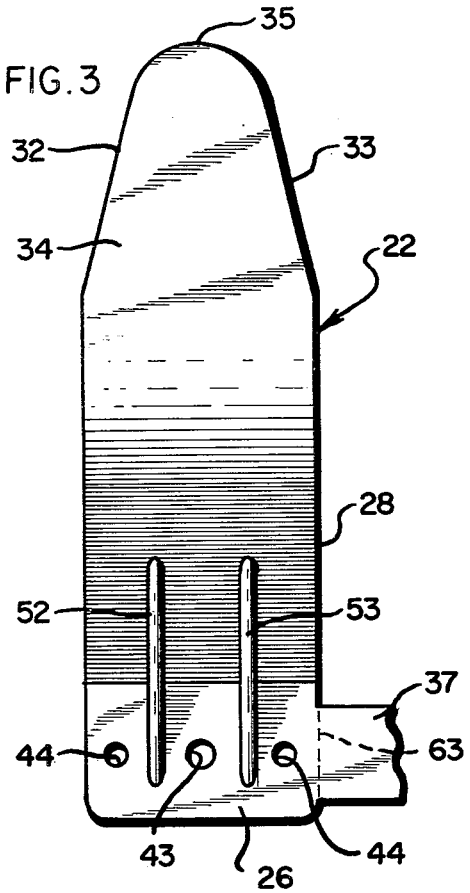
FIG. 3 is an elevational view of the outer side of the left support member of the device as viewed in FIG. 2.
Figure 4:
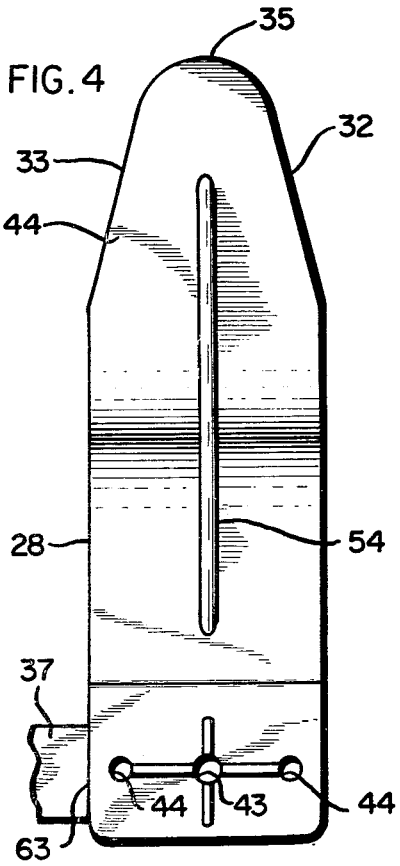
FIG. 4 is an elevational view of the inner or opposite side of the support member illustrated in FIG. 3.

Referring now to FIGS. 3 and 4 in conjunction with FIG. 2, it will be seen that the device 10 comprises at least one and preferably a pair of elongated support members or tongues 22 and 23, each of which includes a generally rectangular, plate-like, mounting portion 26, a plate-like retaining portion 27 that is spaced from the mounting portion 26, and a connecting portion 28. The side edges, indicated at 32 and 33, of the upper section, indicated at 34, of each retaining portion 27 preferably taper toward the remote, convex, upper end, indicated at 36, of the support member. This configuration facilitates extension of the retaining portions 27 into the interior of hollow articles, such as the shoes 12 and 13.

The connecting portions 28 preferably extend obliquely with respect to the mounting and retaining portions so that the retaining portions 27 are spaced from a vertical surface 36 on which the device 10 is mounted when the mounting portions 36 are secured thereto. The surface 36 may comprise the facing surface of a closet wall indicated generally, at W, or the side of a door (not shown). The spaced relationship between the retaining portions 27 and the surface 36 are clearly shown in FIG. 5.

In order to maintain the support members 22 and 23 in laterally spaced, vertically extending, fixed relation when the device 10 is operatively mounted on the vertical surface 35, a connecting member or crossbar 37 extends between and rigidly interconnects the mounting portions 26. The crossbar 37 is preferably formed integrally with the support members 22 and 23 and may be provided with a central opening (not shown) for receiving a fastener, such as a wood screw 38 and a plurality of laterally spaced openings, indicated at 42–44, respectively, in FIG. 3, for receiving one or more fasteners, such as a wood screw 46 (FIG. 2). A wood screw 47 is shown engaged in the center opening of the mounting portion 26 of the support member 23. It will be understood that other types of fasteners, such as tacks, nails, or adhesives, could be employed to secure the device 10 to the vertical surface 36.

In order to strengthen the junction of the connecting portions 28 with the mounting portions 26 of the support members 22 and 23, a pair of laterally spaced, longitudinally extending strengthening ribs 52 and 53 are provided for this purpose. The strengthening ribs 52 and 53 are preferably formed integrally with the material of the mounting and connecting portions 26 and 28 and are positioned between the openings 42,43 and 43,44, respectively.

Figure 5:
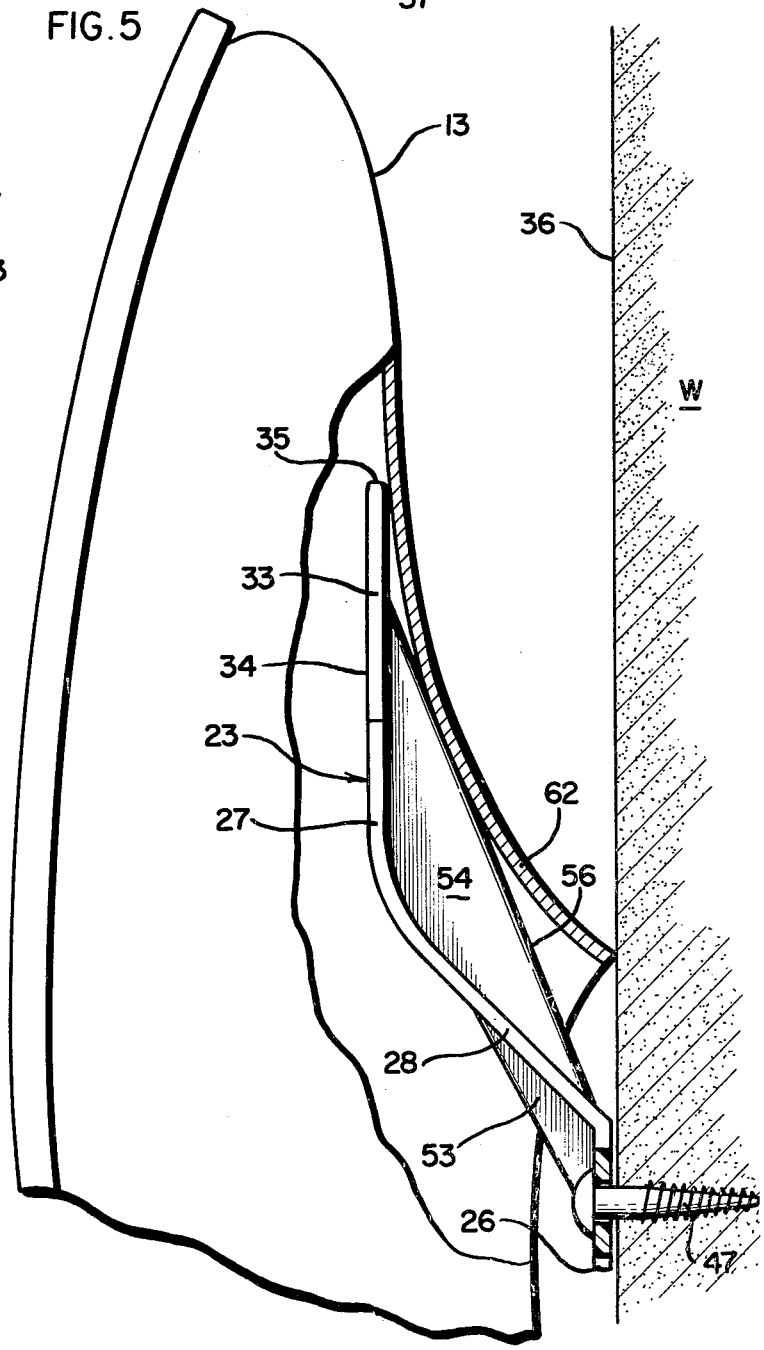
FIG. 5 is a fragmentary, vertical sectional view, with portions thereof in elevation, taken substantially along the line 5—5 FIG. 1.

As best seen in FIGS. 4 and 5, each support member 22 and 23 also includes at least one longitudinally extending, reinforcing rib 54, which extends between the inner or mounting sides of the retaining and connecting portions 27 and 28, respectively. Each rib 54 is thus generally triangularly-shaped and the hypotenusal edge thereof, indicated at 56, extends diagonally upwardly and outwardly from the mounting portion 26 toward the retaining portion 27. Thus, while hollow articles, such as the shoes 12 and 13, are being engaged with the support members 22 and 23 by lowering the shoes onto the support members, the edges 56 of the reinforcing ribs 54 serve to direct the articles downwardly and inwardly toward the facing surface 36 until the article wedges between the wall and the inclined edge 56. In FIG. 5, the tongue portion, indicated at 62 of the shoe 13 is shown engaged with the surface 36 of the wall W.

Figure 6:
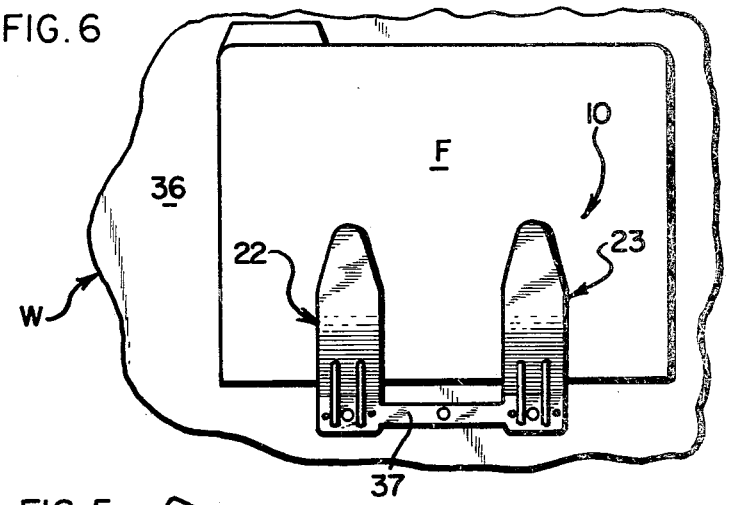
FIG. 6 is a front elevational view, on a reduced scale, of the article support device of the present invention as the latter would appear when supporting a file folder.

With the foregoing construction, it will now be apparent that the device 10 may be used to conveniently store a pair of shoes, such as the shoes 12 and 13, on a vertical surface of an interior wall of a room or closet, or one side of a door. Installation is easily and rapidly effected by drilling one or more openings in the surface on which the device 10 is to be mounted and securing the same thereto by appropriate fasteners, such as the wood screws 38, 46, and 47 illustrated in FIG. 2. When so installed, a pair of shoes, such as the shoes 12 and 13 may be rapidly and easily engaged with the device 10, merely by aligning the tapered upper sections 34 of the retaining portions 27 of the support members 22 and 23 with the interiors of the shoes and permitting the shoes to shift downwardly on the support members until the tongue areas or portions 62 engage the facing surface 36 of the wall W, or wedge between the lower end of the edge 56 of the rib 54 and the surface 36. When so engaged, the shoes are retained in their upright, stored positions illustrated in FIG. 1 until again needed. In Fig. 6, alternate use of the article supporting device 10 is illustrated, namely, as a file holding device. Thus, a file folder F is shown as it would appear when in a stored position between the support members 22 and 23 of the device 10 and the surface 36 of the wall W.

In addition to being usable as a shoe or file holding device, the device 10 may be used to support other types of small articles which may be engaged with one or the other or both of the support members 22 and 23 when the latter is mounted on a wall, door, or other vertical surface. For example, the device 10 may also be used as a hook for retaining hand or bath towels, or items of clothing.

While the device 10 has been herein illustrated and described as including a pair of upright support members 22 and 23, which are joined by an integral crossbar 37, more or less than this number of support members could be employed in the device, if desired. In other words, the device 10 could comprise only one support member. In such a modification, the crossbar 37 would be eliminated. Alternately, the crossbar 37 could be formed with reduced thickness areas or fracture zones, indicated at 63 in FIGS. 2, 3, and 4, which permit the support members 22 and 23 to be broken off of and separated from the crossbar 37. In modifications in which three or more support members are utilized, the crossbar 37 would be lengthened to interconnect the additional support members.

The device 10 can be formed from any desired material having the necessary strength characteristics. However, it is preferably formed from plastic which can be injection molded. High impact polystrene is an example of a preferred material, although other thermal plastic compounds, such as general purpose styrene, could also be used. Alternatively, the device 10 could be of aluminum, magnesium, or zinc, and formed by die casting.

While only one embodiment of the invention has been herein illustrated and described, it will be understood that modifications and variations thereof may be effected without departing from the scope of the invention as set forth in the appended claims.

I claim:

1. A device for supporting and storing small articles, such as at least one shoe, or the like, on a generally vertical surface, such as the facing side of a vertical wall or door, said device comprising at least one elongated support member adapted to be secured to said vertical surface in an upright position, each support member including a mounting portion adapted to be secured to said vertical surface, a retaining portion spaced above and horizontally offset from said mounting portion, and a connecting portion connecting said mounting and retaining portions, at least one longitudinally extending reinforcing rib extending between the connecting and retaining portions of said support member on the side thereof which faces said vertical portion, said mounting, retaining and support portions and said rib being integrally formed by a molding process, whereby an article may be supported by and stored on said device by engaging a portion of the article with at least the connecting portion of the device when the latter is mounted on said vertical surface.

2. The device of claim 1, in which said connecting portion extends obliquely between said mounting and retaining portions, whereby said retaining portion is spaced from the facing side of said vertical surface when said mounting portion is secured thereto.

3. The device of claim 2, in which at least one longitudinally extending strengthening rib extends between the mounting and connecting portions of said support member.

4. The device of claim 3, in which a laterally spaced pair of said strengthening ribs extend between said mounting and connecting portions.

5. The device of claims 1, 2, 3, or 4 in which said device includes a laterally spaced pair of said elongated support members, and a connecting member connects the mounting portions of said support members.

6. The device of claim 5, in which said support members and said connecting member are of thermal plastic.

7. The device of claim 5, in which the length of said connecting member is such as to permit a pair of shoes to be conjointly engaged with and respectively supported by the support members of said device in side-by-side relation.

* * * * *